US012135040B2

(12) United States Patent
Henderson et al.

(10) Patent No.: US 12,135,040 B2
(45) Date of Patent: Nov. 5, 2024

(54) CENTRIFUGAL WELL PUMP WITH THREADEDLY COUPLED DIFFUSERS

(71) Applicant: Schlumberger Technology Corporation, Sugar Land, TX (US)

(72) Inventors: Andrew Robert Charles Henderson, Fife (GB); Calum Crawford, Aberdeenshire (GB); Ivor Maciver, Aberdeenshire (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 87 days.

(21) Appl. No.: 17/871,361

(22) Filed: Jul. 22, 2022

(65) Prior Publication Data

US 2023/0012388 A1 Jan. 12, 2023

Related U.S. Application Data

(63) Continuation of application No. PCT/EP2021/051522, filed on Jan. 22, 2021.
(Continued)

(51) Int. Cl.
*F04D 29/44* (2006.01)
*E21B 43/12* (2006.01)
(Continued)

(52) U.S. Cl.
CPC ..... *F04D 29/448* (2013.01); *E21B 43/128* (2013.01); *F04D 1/06* (2013.01);
(Continued)

(58) Field of Classification Search
CPC ..... F04D 29/448; F04D 29/44; F04D 29/40; F04D 29/086; F04D 29/628; F04D 29/62;
(Continued)

(56) References Cited

U.S. PATENT DOCUMENTS 1,929,077 A * 10/1933 Rose ..... F04D 29/2205 415/199.2
3,150,598 A * 9/1964 Ogles ..... F04D 13/10 415/230
(Continued)

FOREIGN PATENT DOCUMENTS

RU 72733 U1 4/2008
RU 2578924 C2 3/2016
(Continued)

OTHER PUBLICATIONS

Zhang, De-sheng et al., "A compact liquefied natural gas pump vane structure," Mar. 2018, CPO, CN 107762979-A (Year: 2018).*
(Continued)

*Primary Examiner* — Woody A Lee, Jr.
*Assistant Examiner* — Joshua R Beebe
(74) *Attorney, Agent, or Firm* — Jeffrey D. Frantz

(57) ABSTRACT

A well pump includes a plurality of diffusers, wherein each diffuser comprises a first threaded coupling on one longitudinal end and a second threaded coupling on an opposed longitudinal end. An impeller is disposed in each diffuser. The plurality of diffusers are coupled end to end to form a pump housing, in which the first threaded coupling on one diffuser is threadedly engaged to the second threaded coupling on adjacent diffuser.

16 Claims, 5 Drawing Sheets

Related U.S. Application Data

(60) Provisional application No. 62/964,811, filed on Jan. 23, 2020.

(51) Int. Cl.

| | |
|---|---|
| ***F04D 1/06*** | (2006.01) |
| ***F04D 13/08*** | (2006.01) |
| ***F04D 13/10*** | (2006.01) |
| ***F04D 29/08*** | (2006.01) |
| ***F04D 29/62*** | (2006.01) |

(52) U.S. Cl.
CPC ..... *F04D 13/086* (2013.01); *F04D 13/10* (2013.01); *F04D 29/086* (2013.01); *F04D 29/628* (2013.01)

(58) Field of Classification Search
CPC ..... F04D 1/06; F04D 13/086; F04D 13/10; E21B 43/128; F03D 1/06
See application file for complete search history.

(56) References Cited

U.S. PATENT DOCUMENTS

| | | | | |
|---|---|---|---|---|
| 3,269,324 | A | 8/1966 | Van Atta | |
| 5,133,639 | A * | 7/1992 | Gay | F04D 29/167 415/199.1 |
| 7,150,600 | B1 * | 12/2006 | Vennat | F04D 31/00 415/218.1 |
| 9,494,164 | B2 * | 11/2016 | Baski | F04D 29/54 |
| 2008/0031731 | A1 * | 2/2008 | Orban | F04D 29/026 415/196 |
| 2013/0341498 | A1 * | 12/2013 | Sheth | G01D 5/35383 250/227.14 |
| 2014/0069628 | A1 * | 3/2014 | McCann | E21B 43/128 166/66.4 |
| 2014/0069629 | A1 | 3/2014 | McCann et al. | |
| 2014/0178190 | A1 * | 6/2014 | Gahlot | F04D 13/10 415/199.1 |
| 2015/0098794 | A1 * | 4/2015 | Baski | F04D 29/086 415/1 |
| 2017/0002823 | A1 * | 1/2017 | Gahlot | F04D 29/061 |
| 2017/0102009 | A1 * | 4/2017 | Johnson | F04D 13/086 |
| 2019/0017518 | A1 * | 1/2019 | Brown | B01D 19/0052 |
| 2019/0085667 | A1 * | 3/2019 | Xiao | F04D 1/066 |
| 2021/0140436 | A1 * | 5/2021 | Ye | F04D 29/043 |
| 2022/0282732 | A1 * | 9/2022 | Ekambaram | F04D 29/041 |

FOREIGN PATENT DOCUMENTS

| | | | | |
|---|---|---|---|---|
| WO | 2007/140549 | A1 | 12/2007 | |
| WO | WO-2015009428 | A1 * | 1/2015 | E21B 4/003 |

OTHER PUBLICATIONS

International Search Report and Written Opinion, International Application No. PCT/EP2021/051522 dated Apr. 7, 2021.
Exam Report issued in United Kingdom Patent Application No. GB2210545.6 dated Jun. 16, 2023, 2 pages.
Re-Exam Report issued in United Kingdom Patent Application No. GB2210545.6 dated Dec. 27, 2023, 3 pages.
Office Action and Search Report issued in Russian Patent Application No. 2022122554 dated May 21, 2024, 10 pages with English translation.

* cited by examiner

CENTRIFUGAL WELL PUMP WITH THREADEDLY COUPLED DIFFUSERS

CROSS-REFERENCE TO RELATED APPLICATIONS

Continuation of International Application No. PCT/EP2021/051522 filed on Jan. 22, 2021. Priority is claimed from U.S. Provisional Application No. 62/964,811 filed on Jan. 23, 2020. Both the foregoing applications are incorporated herein by reference in their entirety.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

FIELD

This disclosure relates to the field of centrifugal fluid pumps. More specifically, this disclosure relates to centrifugal pumps used to lift fluids from subsurface wells.

BACKGROUND

Subsurface deployed ("downhole") multi-stage centrifugal pumps are used in wells drilled through subsurface earthen formations for the purpose of lifting fluids to surface. Such pumps are known to have a selected number of "stages", that is sections each having an impeller and a diffuser, disposed longitudinally in a housing. The number of such stages is related to the amount of lift required of the particular pump such that it may be operated under efficient conditions. To assemble such pumps, it is known in the art to insert and compress a stack of stages into a pump housing. Due to diameter, design and application restrictions, obtaining the best possible pump performance is challenging with these existing assembly methods. This assembly method also requires the inefficient use of valuable design/flow area, especially for very small diameter pumps such as those sold by Zilift Ltd., Aberdeen, Scotland.

Such known assembly method also requires long and specialized tooling to enable assembly and repair or resizing (changing the number of stages) of a particular pump. The space required for this assembly, repair or resizing is typically a minimum of twice the length of the pump housing or drive shaft.

It is desirable to have a centrifugal pump system that can be readily reconfigured to have a different number of stages, to repair or replace individual stages and assemble the pump without the need for lengthy assembly apparatus.

SUMMARY

One aspect of the present disclosure is a well pump. The pump includes a plurality of diffusers, wherein each diffuser comprises a first threaded coupling on one longitudinal end and a second threaded coupling on an opposed longitudinal end. An impeller is disposed in each diffuser. The plurality of diffusers are coupled end to end to form a pump housing, in which the first threaded coupling on one diffuser is threadedly engaged to the second threaded coupling on adjacent diffuser.

The first threaded coupling on one diffuser and the second threaded coupling on another diffuser may form a metal to metal seal when threadedly engaged to each other.

The first threaded couplings may be sealed with an O-ring or similar elastomeric seal, or may be sealed with an elastomer seal and a metal-metal seal.

The well pump may further comprise a drive shaft inserted into the impeller in each diffuser.

The well pump may further comprise a protector coupled to one end of the plurality of diffusers.

The well pump may further comprise a motor coupled to an end of the protector opposed to the end of the protector coupled to the one end of the plurality of diffusers.

The motor may comprise an electric motor.

Each diffuser may comprise a separate diffuser body and diffuser vanes, wherein the diffuser vanes may fit into each diffuser body.

Each impeller may be axially movably attached to a drive shaft. Each impeller and each diffuser may comprise a respective axial thrust face, wherein axial force generated by the impellers may be transferred to the diffusers.

The first threaded coupling may be a male threaded connector and the second threaded coupling may be a female threaded connector.

A method for assembling a well pump according to another aspect of the present disclosure includes disposing an impeller in each of a plurality of diffusers. Each diffuser comprises a first threaded coupling on one longitudinal end and a second threaded coupling on an opposed longitudinal end. The plurality of diffusers is threadedly coupled end to end and the threadedly coupled diffusers are deployed in a well.

The first threaded coupling on one diffuser and the second threaded coupling on another diffuser may form a metal to metal seal when threadedly engaged to each other.

The first threaded coupling on one diffuser may be sealed to the second threaded coupling on another diffuser using an elastomer seal.

The method may further comprise inserting a drive shaft into the impeller in the plurality of diffusers.

The method may further comprise assembling a protector to one end of the plurality of diffusers.

The method may further comprise assembling a monitoring and star point sub and at least one motor to an end of the protector opposed to the end of the protector coupled to the one end of the plurality of diffusers.

The at least one motor may comprise an electric motor.

Each diffuser may comprise a separate diffuser body and diffuser vanes, wherein the diffuser vanes may fit into each diffuser body.

The method may further comprise assembling each impeller axially movably to a drive shaft. Each impeller and each diffuser may comprise a respective axial thrust face, wherein axial force generated by the impellers may be transferred to the diffusers.

The first threaded coupling may be a male threaded connector and the second threaded coupling may be a female threaded connector.

Other aspects and possible advantages will be apparent from the description and claims that follow.

DETAILED DESCRIPTION

Figure 1:
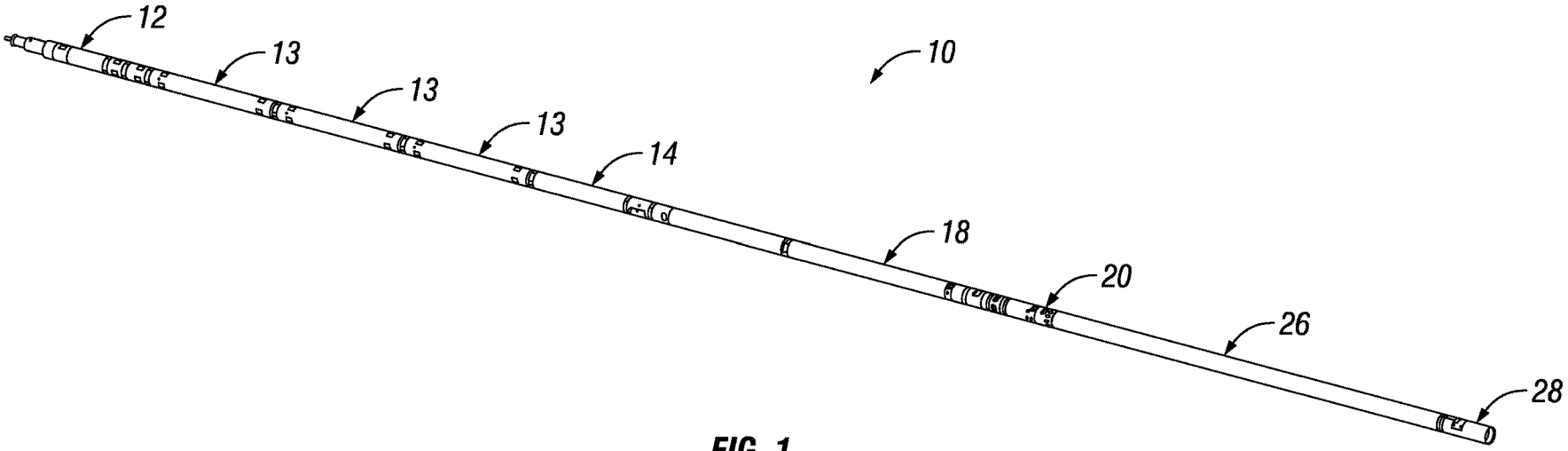
FIG. 1 shows and example centrifugal pump system that may be deployed in a subsurface well.

FIG. 1 shows an example embodiment of a well pump system, such as an electric submersible pump (ESP) system 10, that may be conveyed into a well (see FIG. 6) using, for example and without limitation, jointed tubing, wireline, slickline or coiled tubing. The ESP system 10 may include an upper or "top" sub 12 that comprises features to make connection to an end of one of the foregoing conveyance devices for movement into and out of the well. A lower end of the ESP system 10 may include an "intake" sub 28. The intake sub 28 may be added below a pump 26, such as a rotary pump, to provide protection while running into the well during deployment, and to provide a mounting location for a pump (e.g., ESP) intake memory gauge or sensors. In addition, the intake sub 28 may provide a suitable location for inner bore sealing as part of a well barrier control mechanism. Both a single shot sealing option and a pressure responsive valve with multiple stable positions may be considered as suitable, but not limiting example options for well sealing below the intake sub 28. For purposes of this disclosure, the term "up" is intended to mean in a direction toward the outlet of a wellbore when the ESP system 10 is installed therein, while "down" is intended to mean in the opposite direction. Corresponding terms may include "upper end" and "lower end" with reference to various modules or sections that make up the ESP system 10. Accordingly, the use of such terms is for ease of understanding and is not intended to limit the scope of the present disclosure. The example embodiment shown in FIG. 1 is an "inverted" ESP system wherein one or more motors, e.g., electric motors, are disposed proximate the top end of the system for deployment on an electrical cable. It should be clearly understood that the respective longitudinal positions of the components shown in FIG. 1 is not intended to limit the scope of the present disclosure. Although the present example embodiment is described as having one or more electric motors, for purposes of defining the scope of the present disclosure, any other form of motor may be used, for example and without limitation, hydraulic motors, pneumatic motors, and rod driven motors.

The top sub 12 may be followed successively by one or more motor(s) 13, which in the present example may be electric motor(s) and a "monitoring and star point sub" 14. The "monitoring and star point sub" 14 may include one or more sensors and control devices (not shown separately) related to operation of the ESP system 10 and the motor(s) 13. The monitoring and star point sub 14 may also be positioned above the motor(s) 13 and used to make electrical connection between a cable (not shown) and the motor(s) 13. The motor(s) 13 may be coupled at the lower end thereof to a solid enclosed driveshaft, a flexible shaft, magnetic gearing or any other rotational motion transmission. In the present example, the rotational motion transmission may be a solid driveshaft disposed inside the "monitoring and star point sub" 14 which accepts rotational input from the motor(s) 13, and transmits such rotational motion to the pump 26, which may be a rotary pump. A protector 18, may be similar in operating principle to the protector ordinarily used in ESP systems, and may be configured to exclude well fluids at existing well pressure and temperature from entering the motor(s) 13. Not shown in FIG. 1 for clarity is a flow shroud that diverts well fluid flow from the pump discharge 20 so that it can travel in an annular space outside the ESP system 10 and be sealingly diverted into a tubing or coiled tubing and thence flow upwardly in the well (not shown).

The present example of ESP system 10 may be of modular design and deployed in the well as separate subassemblies, or the entire ESP system 10 may be lowered into the well as an assembled unit, e.g., as shown in FIG. 1. The pump 26, the protector 18, the monitoring and star point sub 14 and the motor(s) 13 may each be enclosed in a respective pressure resistant housing, and such housings may be coupled by threads, locking rings or any other device known in the art for joining housings or housing segments together end to end. Various sections of a pump system constructed as disclosed herein in the form of modules can be (quick) coupled to other pump modules, thrust and discharge modules and intake pressure modules, for example. The specific coupled components as disclosed herein are not intended to limit the scope of other components that may be similarly coupled to a pump system according to this disclosure.

Figure 2:
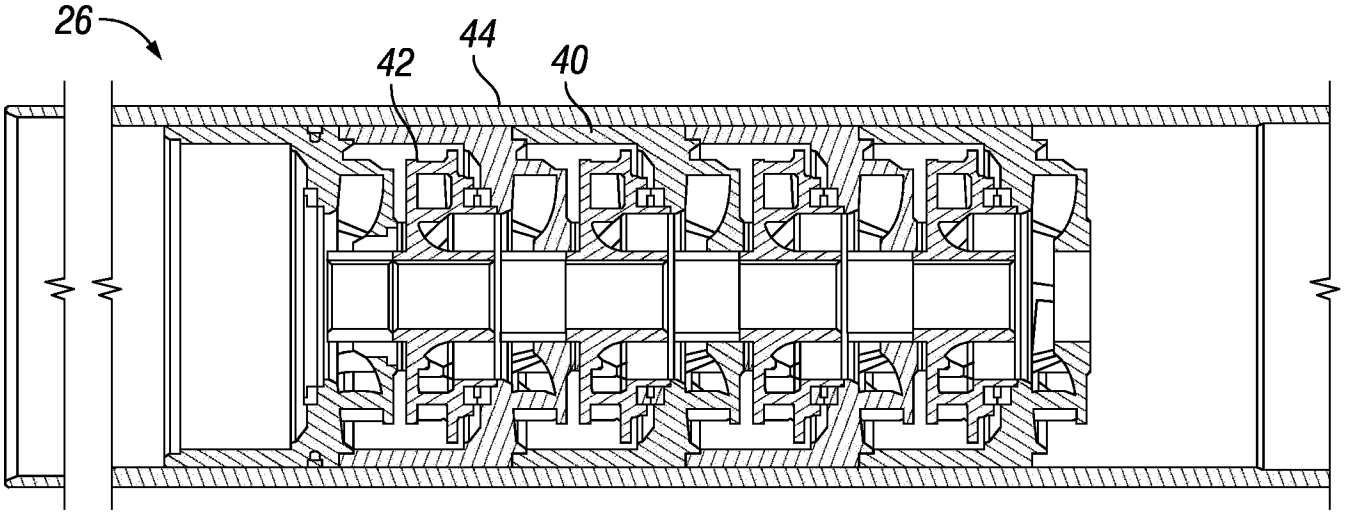
FIG. 2 (Prior Art)
FIG. 2 shows a cross sectional view of a multiple stage centrifugal well pump known in the art prior to the present disclosure.

In order to better understand the structure of a well pump according to the present disclosure, FIG. 2 shows, for comparison purposes, a cross-sectional view of a multiple stage centrifugal well pump 26 known in the art prior to the present disclosure. A plurality of diffusers 40 and associated impellers 42 are disposed longitudinally adjacently end to end in a housing 44. The housing 44 may be a generally cylindrical, solid tube into which successive impeller 42/diffuser 40 combinations are inserted. Typically, the plurality of impellers/diffusers, known as a "stack" is inserted into the housing 44, then is compressed axially to provide rotational locking, sealing and room for thermal expansion. Disassembly of the pump 26 may be performed by reversing the foregoing assembly operation.

Figure 3:
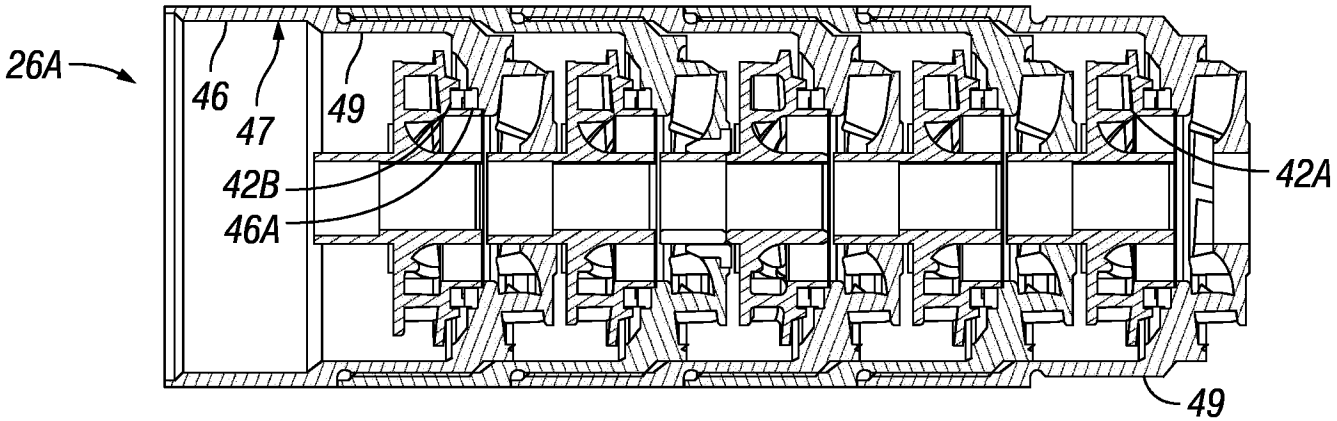
FIG. 3 shows a cross sectional view of an example embodiment of a multiple stage centrifugal well pump according to the present disclosure.

FIG. 3 shows a corresponding cross-sectional view of an example embodiment of a well pump according to the present disclosure. The pump 26A may comprise a plurality of diffusers 46 coupled together end to end. Each diffuser 46 may have disposed therein a corresponding impeller 42A. Each diffuser 46 comprises at one longitudinal end a first threaded coupling, which may be an internally threaded female connector 47, and on the opposite longitudinal end, a second threaded coupling, which may be an externally threaded male connector 49. The male connector 49 has diameter and thread configuration to threadedly engage the female connector 47 of an adjacent diffuser 46. The threads, thread reliefs and/or thread shoulders, seal diameters, as applicable, of the male connector 49 and the female connector 47 may comprise features to enable provision of an elastomeric seal such as an O-ring, a metal to metal seal, or both a metal to metal and elastomeric seal on engagement of a female connector 47 to a male connector 49 between adjacent diffusers 46. In this way, assembling a plurality of diffusers 46 may provide the functional equivalent of the housing (44 in FIG. 2) of a centrifugal well pump known in the art prior to the present disclosure as explained with reference to FIG. 2. That is, fluid may be constrained to flow longitudinally within the interior of the space defined by the assembled diffusers 46. In the example embodiment shown, the exterior surface (47A in FIG. 4) of the female connector 47 may be the same as the external diameter of a correspondingly sized (i.e., outer or external diameter) conventional well pump, such as shown in FIG. 2. An internal diameter of the male connector 49 may be larger diameter than the internal diameter of a diffuser in a correspondingly sized conventional well pump (see FIG. 2). Such increased internal diameter may provide that the impellers 42A in the present example embodiment may be larger diameter than those in a correspondingly sized conventional well pump. Increased internal diameter and increased impeller diameter may provide increased flow area, and such increased diffuser and impeller diameters may provide a well pump according to the present disclosure with greater head and/or flow rate than correspondingly sized conventional well pumps in accordance with pump affinity laws.

While in the present example embodiment, the first threaded coupling is described as a female threaded connector, and the second threaded coupling is described as a male threaded connector. It will be appreciated that it is fully within the scope of the present disclosure for the first threaded coupling to be either male or female thread, and the same applies to the second threaded coupling. If the first and second threaded couplings are both male threaded connectors or are both female threaded connectors, a respective double female or double male connector may be used to connect adjacent diffusers.

Figure 4:
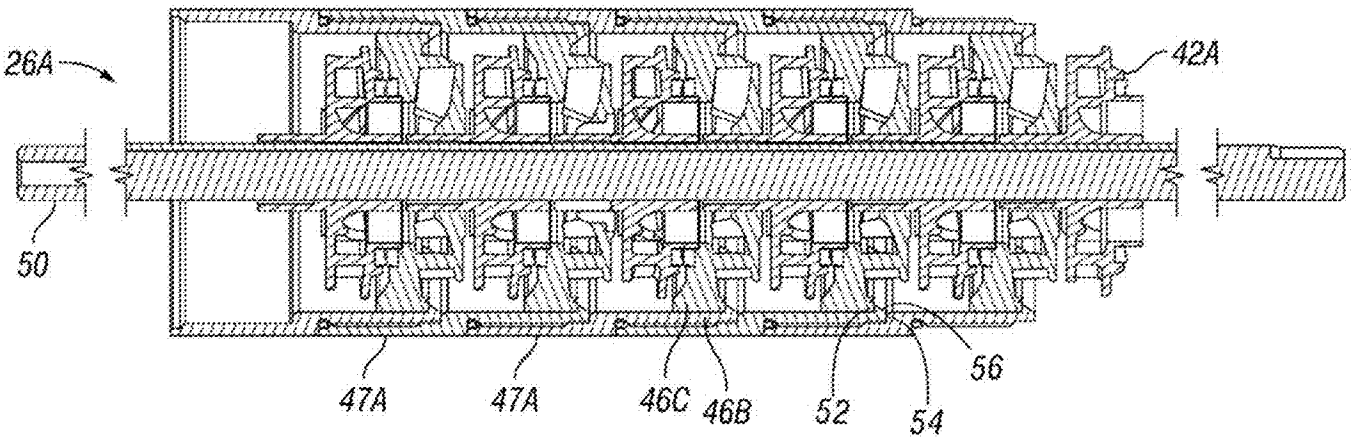
FIG. 4 shows a cross sectional view of an example embodiment of a multiple stage centrifugal well pump where each diffuser comprises a separate diffuser body and diffuser vanes, wherein the diffuser vanes are fit into each diffuser body this embodiment also shows a drive shaft installed.

In the embodiment of FIG. 3, the impellers 42A may comprise an internal opening that is shaped to accept a keyed drive shaft (50 in FIG. 4). The size of the internal opening on each impeller 42A may be made such that the impellers 42A may move axially along the drive shaft (50 in FIG. 4). Axial thrust forces produced by the impellers 42A may be respectively transferred to each impeller's corresponding diffuser 46 by having opposed thrust surfaces 42B, 46A (e.g., thrust faces), respectively on the impellers 42A and diffusers 46.

Such thrust surfaces 42B, 46A may comprise bearing material suitable for transfer of such axial thrust forces. In this way, thrust applied to a thrust bearing (not shown) will be reduced as contrasted with conventional pumps having axially fixed impellers. The example embodiment shown in FIG. 3 provides that the impellers 42A are not axially locked to a driveshaft (see below with reference to FIG. 4). Such feature is not intended to limit the scope of the present disclosure; other embodiments may have some or all of the impellers 42A axially locked to the drive shaft.

FIG. 4 shows the cross sectional view of FIG. 3 wherein a main drive shaft 50 is inserted through the impellers 42A. The pump 26 shown in and explained with reference to FIGS. 3 and 4 may be assembled to an ESP system as explained with reference to FIG. 1. An additional feature of the example embodiment shown in FIG. 4 as contrasted with that of FIG. 3 is that the diffusers 46 may comprise two separate components for ease of manufacture, assembly and quality control. A diffuser body 46B may comprise the female and male connectors (47, 49, respectively in FIG. 3).

Diffuser vanes 46C may be formed as a separate component. The diffuser vanes 46C may be shrink fit or press fit into the diffuser body 46B to assemble a complete diffuser 46, which may be assembled as explained above. The diffuser body 46B may include an integral annular shoulder 52 disposed at an axial offset distance from an axial end 54. The diffuser body 46B may include a tapered annular surface 46 that extends directly from the integral annular shoulder 52 to the axial end 54 of the diffuser body 46B.

Figure 5:
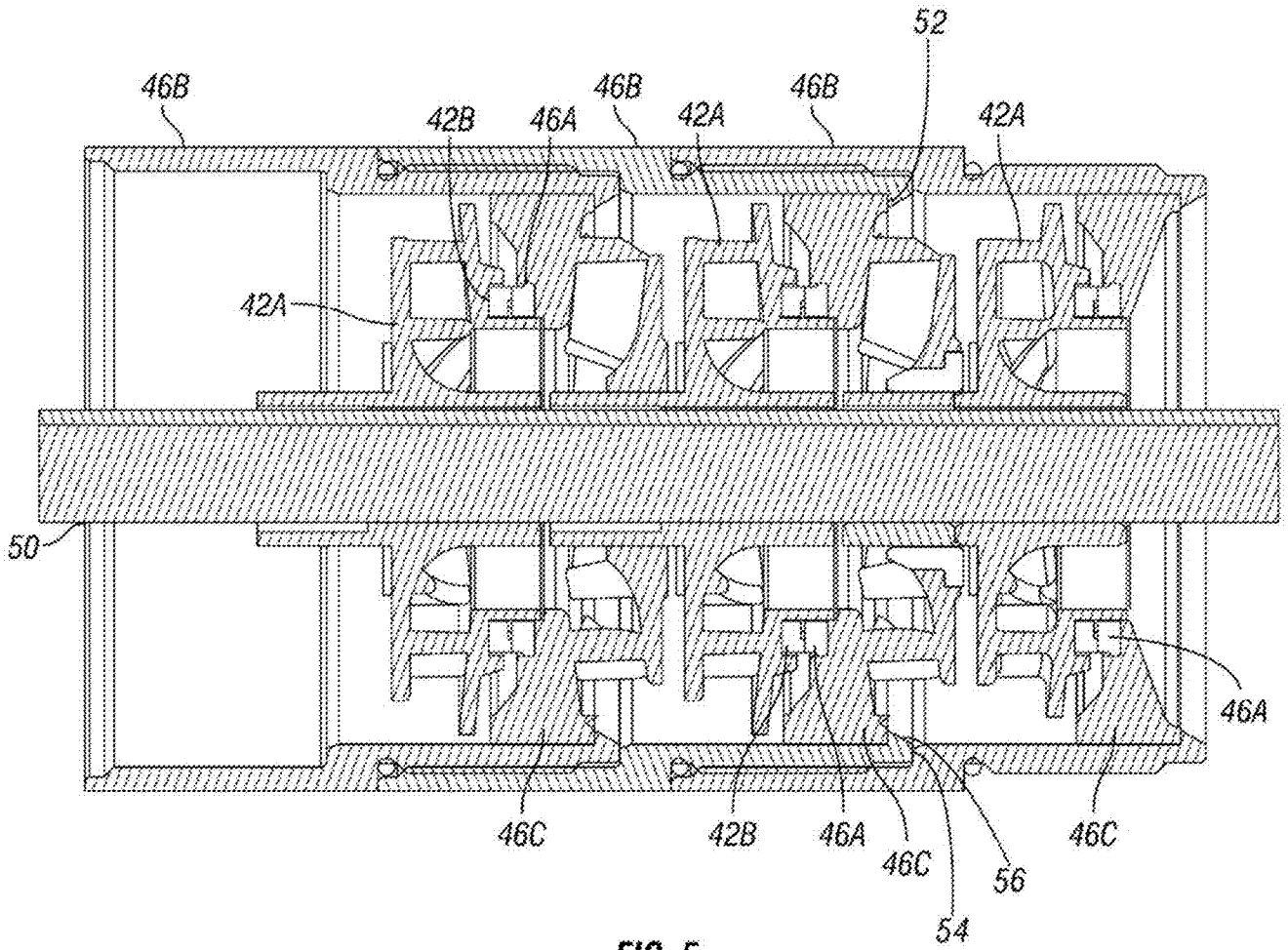
FIG. 5 is an enlarged view corresponding to FIG. 4.

FIG. 5 shows a view similar to that of FIG. 4 in enlarged scale for better understanding of the separate diffuser vanes 46C, diffuser bodies 46B and respective thrust surfaces 42B, 46A.

Figure 6:
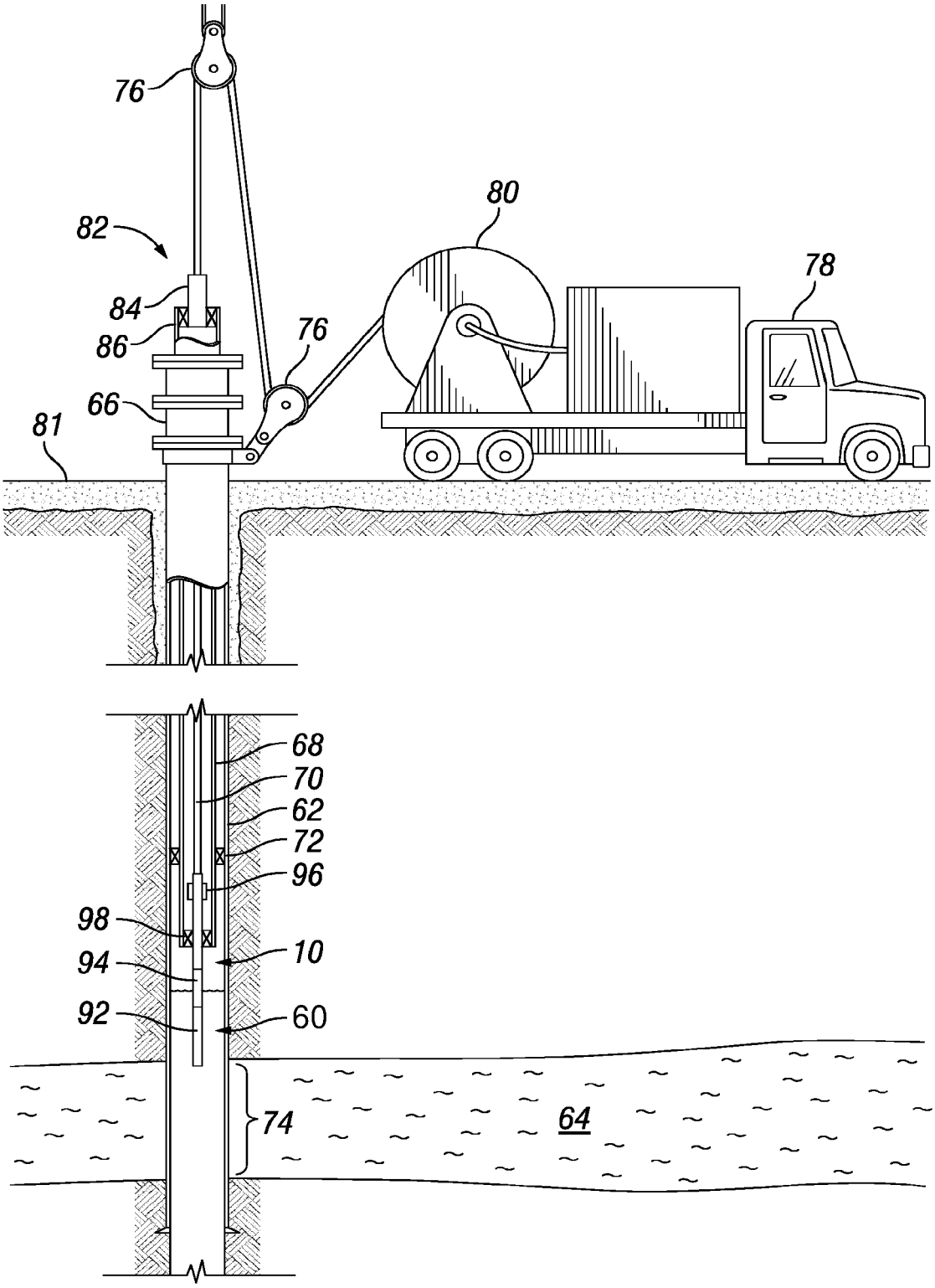
FIG. 6 shows an example embodiment of deploying a pump system in a well.

FIG. 6 shows an example embodiment of deploying a pump system in a well or wellbore. The wellbore 60 is drilled through subsurface formations including a fluid producing formation 64. The producing formation 64 may have hydrocarbons and water therein, and when the formation 64 is exposed to a pressure in the wellbore 60 lower than the fluid pressure in the producing formation 64, such pressure may urge the hydrocarbons and water in various amounts into the wellbore 60. The wellbore 60 may have cemented in place therein a protective pipe or casing 62 that extends from a wellhead 66 at the surface 81. A length of smaller diameter pipe or "tubing" 68 nested in the casing 62 may extend from the wellhead 66 to a selected depth in the wellbore 60, typically, although not necessarily above the depth of the producing formation 64. The tubing 68 may be provided to increase the velocity of fluid moved from the producing formation 64 to the wellhead 66. An annular space between the tubing 68 and the casing 62 may be closed to fluid communication by an annular seal or packer 72. The casing 62 may include perforations 74 therein at a depth corresponding to the depth of the producing formation 64 to enable fluid flow from the producing formation 61 to move into the wellbore 60.

A wellbore pump system 10, substantially as explained with reference to FIGS. 1 through 5, may be connected to one end of a deployment cable, pipe "string" or conduit. In some embodiments, the deployment string, cable or conduit may be a tubing encapsulated cable (TEC) 70. As explained above with reference to FIG. 1, however, it should be clearly understood that any other known device for deploying an ESP system in a well may be used in accordance with this disclosure. The wellbore pump system 10 may include a high speed, permanent magnet AC electric motor 94 rotationally coupled to a pump 92 as explained above. In some embodiments, the wellbore pump system 10 may include a remotely controllable, inflatable annular seal 98 to close off fluid communication between an inlet of the pump 92 and a pump fluid discharge 96 disposed in the tubing 68. In other embodiments the annular seal 98 may already be in place in the tubing 68 or in the casing 62. In other embodiments, the tubing 68 may not be used; the wellbore 60 may be completed using only a casing.

The TEC 70 may be stored on and deployed from a drum, reel or spool forming part of a winch such as a wireline winch 80. The wireline winch 80 may be mounted on a vehicle 78 for on road transportation. In other embodiment the winch 80 may be a "skid" mounted unit for use on offshore well service units. The TEC 70 may be extended into the wellbore 60 through suitably positioned sheave wheels 76 positioned as would ordinarily be used in deployment of wireline wellbore measuring instruments or intervention instruments.

A wireline pressure control head 82 may be coupled to the top of the wellhead 66. The wireline pressure control head 82 may include an hydraulically compressible seal element 84 disposed in a bladder 86. The bladder 86 may be inflated by hydraulic pressure using equipment (not shown) known in the art for such purpose. The seal element 84 may have an internal opening sized to seal on an exterior surface of the TEC 27 to substantially prevent escape of fluid under pressure as the ESP system 10 and the TEC 70 are extended into the wellbore 60 or withdrawn from the wellbore 60. The seal element 84 may also substantially prevent fluid from escaping around the exterior of the TEC 70 during operation of the ESP system 10.

A centrifugal pump made according to the present disclosure herein does not require a separate housing and multiple diffusers, and instead combines the diffusers longitudinally to form an equivalent structure to the housing. The diffusers thread together end to end and seal between each other, isolating the pump discharge from the pump inlet. The pump can be re-staged much quicker as the thrust assembly and discharge does not need to be dismantled. Possible advantages of this design may include one or more of the following.

Improved pump performance (head and/or flow) may result from increased flow/design area with respect to a conventional multiple stage centrifugal pump with the same external diameter. The same length of pump can be used for higher flow rate applications and/or higher head applications.

A well pump made according to the present disclosure may be easier to re-stage for different well applications. The space needed and tooling required to change the number of stages in the pump is greatly reduced, providing possible faster turnaround between each job or between applications. Such feature may be particularly useful for short term well intervention which requires frequent restaging of the centrifugal pump, preferably in the field.

The pump thrust assembly, discharge and connections between subassemblies do not need to be disassembled in order to re-stage a pump, saving time, cost, consumable components and motor oil. This is because the pump can be split and dismantled at any diffuser without having to remove the entire pump stage stack from a housing.

Such a well pump can provide reduced pump weight for the same head and/or flow as a correspondingly sized (outer diameter) pump. A lighter pump aids assembly and handling as well as increasing maximum running depth.

Diffuser casting or 3D-print may be shortened in length considerably, thereby reducing material used, casting/printing complexity, casting/printing cost and time, and final machining cost and time.

The threaded diffuser bodies may be machined from billet or coupling stock to ensure material properties for strength, hardness and chemical resistance etc. The diffuser vanes may be printed/cast and press fit or shrink fit into the diffuser bodies. The machined diffuser bodies are then threaded together end to end to create the required length of assembly and numbers of stages to match application requirements. By avoiding the diffusers being stacked, inserted then compressed inside a separate housing, the pump can be stripped from the inlet end, meaning the thrust and discharge section at the top of the pump can stay in place or be attached to the rest of the assembly during re-stage for quick turnaround well intervention applications. As long, specialized tooling for pump assembly and disassembly of conventional well pumps is not required, re-staging operation can take place in a smaller area and with simple, readily available hand tools such as may be available at a well location. Such make possible re-stage of a well pump at a well location.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

The invention claimed is:

1. A well pump, comprising:

a plurality of diffusers, each diffuser comprising a first threaded coupling on one longitudinal end and a second threaded coupling on an opposed longitudinal end, wherein each diffuser of the plurality of diffusers comprises a diffuser body and a set of diffuser vanes, wherein the set of diffuser vanes is mounted in the diffuser body via an annular mounting interface comprising a press-fit or a shrink fit between a radially outer circumferential surface of the set of diffuser vanes and a radially inner circumferential surface of the diffuser body, wherein each diffuser body of the plurality of diffusers has an integral annular shoulder formed directly adjacent the radially inner circumferential surface, wherein each diffuser body of the plurality of diffusers has the integral annular shoulder at an axial offset distance from an axial end of the diffuser body, wherein a tapered annular surface extends directly from the integral annular shoulder to the axial end of the diffuser body, wherein an axial end of the set of diffuser vanes abuts the integral annular shoulder, and wherein the annular mounting interface and the integral annular shoulder hold the set of diffuser vanes at an axial position within the diffuser body;

a plurality of impellers, each impeller being disposed adjacent to the set of diffuser vanes in each diffuser of the plurality of diffusers; and a plurality of thrust bearings, each thrust bearing being disposed between the impeller and the set of diffuser vanes in each diffuser of the plurality of diffusers, wherein the plurality of diffusers, the plurality of impellers, and the plurality of thrust bearings are assembled into a plurality of sub-assemblies, wherein each sub-assembly of the plurality of sub-assemblies includes one of the plurality of diffusers, one of the plurality of impellers, and one of the plurality of thrust bearings, wherein the plurality of sub-assemblies are coupled end to end in a plurality of pump stages, wherein the plurality of diffusers form a pump housing, wherein the first threaded coupling on one diffuser is threadedly engaged to the second threaded coupling on an adjacent diffuser via a threaded connection.

2. The well pump of claim 1, wherein the first threaded coupling on one diffuser and the second threaded coupling on another diffuser form a metal to metal seal when threadedly engaged to each other.

3. The well pump of claim 1, wherein the first threaded coupling on one diffuser is sealed to the second threaded coupling on another diffuser using an elastomer seal.

4. The well pump of claim 1, further comprising a protector coupled to one end of the plurality of diffusers.

5. The well pump of claim 4, further comprising a monitoring and star point sub and at least one motor coupled to an end of the protector opposed to the end of the protector coupled to the one end of the plurality of diffusers.

6. The well pump of claim 5, wherein the at least one motor comprises an electric motor.

7. The well pump of claim 1, wherein each impeller is axially movably attached to a drive shaft, wherein each impeller and each diffuser comprise a respective axial thrust surface, and wherein an axial force generated by the impeller is transferred to the diffuser through the thrust bearing between the axial thrust surfaces.

8. The well pump of claim 7, wherein the thrust bearing is radially offset by a first distance from the drive shaft and a second distance away from the radially inner circumferential surface of the diffuser body.

9. A method for assembling a pump stage of a well pump, comprising:

disposing an impeller in each of a plurality of diffusers, each diffuser comprising a threaded first coupling on one longitudinal end and a second threaded coupling on an opposed longitudinal end;

mounting a set of diffuser vanes in a diffuser body of each diffuser of the plurality of diffusers via an annular mounting interface comprising a press-fit or a shrink fit between a radially outer circumferential surface of the set of diffuser vanes and a radially inner circumferential surface of the diffuser body, wherein each diffuser body of the plurality of diffusers has an integral annular shoulder formed directly adjacent the radially inner circumferential surface, wherein each diffuser body of the plurality of diffusers has the integral annular shoulder at an axial offset distance from an axial end of the diffuser body, wherein a tapered annular surface extends directly from the integral annular shoulder to the axial end of the diffuser body, wherein an axial end of the set of diffuser vanes abuts the integral annular shoulder, wherein the annular mounting interface and the integral annular shoulder hold the set of diffuser vanes at an axial position within the diffuser body, and wherein each impeller is disposed adjacent to the set of diffuser vanes in each diffuser of the plurality of diffusers;

disposing a thrust bearing between the impeller and the set of diffuser vanes in each diffuser of the plurality of diffusers; and threadedly coupling the plurality of diffusers end to end via a threaded connection between each adjacent pair of diffusers of the plurality of diffusers, wherein the plurality of diffusers form a pump housing.

10. The method of claim 9, wherein the first threaded coupling on one diffuser and the second threaded coupling on another diffuser form a metal to metal seal when threadedly engaged to each other.

11. The method of claim 9, wherein the first threaded coupling on one diffuser is sealed to the second threaded coupling on another diffuser using an elastomer seal.

12. The method of claim 9, further comprising assembling a protector to one end of the plurality of diffusers.

13. The method of claim 12, further comprising assembling a monitoring and star point sub and at least one motor to an end of the protector opposed to the end of the protector coupled to the one end of the plurality of diffusers.

14. The method of claim 13, wherein the at least one motor comprises an electric motor.

15. The method of claim 9, further comprising assembling each impeller axially movably to a drive shaft, wherein each impeller and each diffuser comprise a respective axial thrust surface, and wherein an axial force generated by the impeller is transferred to the diffuser through the thrust bearing between the axial thrust surfaces.

16. The method of claim 15, wherein the thrust bearing is radially offset by a first distance from the drive shaft and a second distance away from the radially inner circumferential surface of the diffuser body.

* * * * *